United States Patent [19]

Van Orsdale, Jr.

[11] 4,226,567

[45] Oct. 7, 1980

[54] APPARATUS FOR HANDLING BOBBINS

[75] Inventor: Laurence S. Van Orsdale, Jr., Taylors, S.C.

[73] Assignee: D. W. Zimmerman Mfg., Inc., Madison Heights, Mich.

[21] Appl. No.: 914,019

[22] Filed: Jun. 9, 1978

[51] Int. Cl.[3] ..... B66C 1/66; B65H 67/00

[52] U.S. Cl. ..... 414/555; 242/35.5 A; 294/93; 414/591; 414/728; 414/733; 414/735; 414/744 A; 414/917

[58] Field of Search ..... 414/555, 589, 591, 728, 414/729, 733, 735, 738, 744, 917; 294/93; 242/35.5 A

[56] References Cited

U.S. PATENT DOCUMENTS

| | | | |
|---|---|---|---|
| 3,741,409 | 6/1973 | Painter | 414/733 |
| 4,138,072 | 2/1979 | Aoyama et al. | 242/35.5 A |

*Primary Examiner*—Robert G. Sheridan
*Attorney, Agent, or Firm*—Allen D. Gutchess, Jr.

[57] ABSTRACT

Apparatus is provided for handling bobbins and particularly for transferring bobbins from one location to another. The apparatus includes a cart having parallel linkages pivotally mounted thereon and connected to a fluid-operated ram. A bobbin-engaging unit is carried at the ends of the linkages and engages the bobbin internally. After engagement, the linkages are manipulated to transfer the bobbin to another location with the weight of the bobbin and mechanism being offset by the fluid-operated cylinder. The cart is designed to be attached to a portable bobbin buggy so that both can then be pushed as a unit to move the buggy to a desired location from which the bobbins are transferred to a creel or rack, for example.

14 Claims, 3 Drawing Figures

APPARATUS FOR HANDLING BOBBINS

This invention relates to apparatus for handling bobbins or the like and for transferring them from one location to another.

Bobbins or spools of filaments, strands, threads, yarn, roving, and the like produced in textile mills often weigh 25–30 lbs or more with some being in the order of 100 lbs. It is tiring for workers to handle a multiplicity of such bobbins over the course of a day. Also, the bobbins may be mishandled and damaged, particularly by a tired worker, and moisture from the hands may be damaging to the filaments, etc.

The apparatus in accordance with the invention includes a bobbin-handling cart mounted on casters or other wheels. The cart is designed to be sufficiently narrow to travel down the aisles of a textile mill and sufficiently low to avoid interference with overhead obstructions. An upright elongate member or sleeve is pivotally mounted on the cart for pivotal movement about a generally vertical axis. An upper link is pivotally connected to an upper portion of the elongate member and a lower link is similarly pivotally connected to a lower portion of the elongate member in spaced relationship with respect to the upper link. A fluid-operated ram is connected to the upper and lower links in a manner such that when fluid is applied to a cylinder of the ram under pressure, it tends to raise the links. An outer, upright elongate member or rod is pivotally connected between outer end portions of the two links. A bracket is pivotally mounted for movement about a generally vertical axis on the outer elongate member and carries a bobbin-engaging unit which has an expandable member that is inserted into the bobbin and engages the inner surface thereof. Fluid under higher pressure is then supplied to the ram to offset a substantial portion of the weight of the bobbin and associated mechanism. The operator can then move the bobbin from a bobbin buggy, for example, to a creel. The bobbin-handling cart has means for being connected to the bobbin buggy so that the two can be manipulated as a unit down aisles of the textile mill to the location of the creel.

In one form, a second fluid-operated ram can be mounted on the outer elongate member to move the bracket vertically with respect to that member, thereby providing additional flexibility in the manipulation of the bobbin-engaging unit. The bobbin-engaging unit also is preferably pivotally mounted with respect to the bracket on the outer elongate member for additional flexibility and ease of handling.

It is, therefore, a principal object of the invention to provide bobbin-handling apparatus having the advantages and features discussed above.

Many other objects and advantages of the invention will be apparent from the following detailed description of a preferred embodiment thereof, reference being made to the accompanying drawings, in which.

Figure 1:
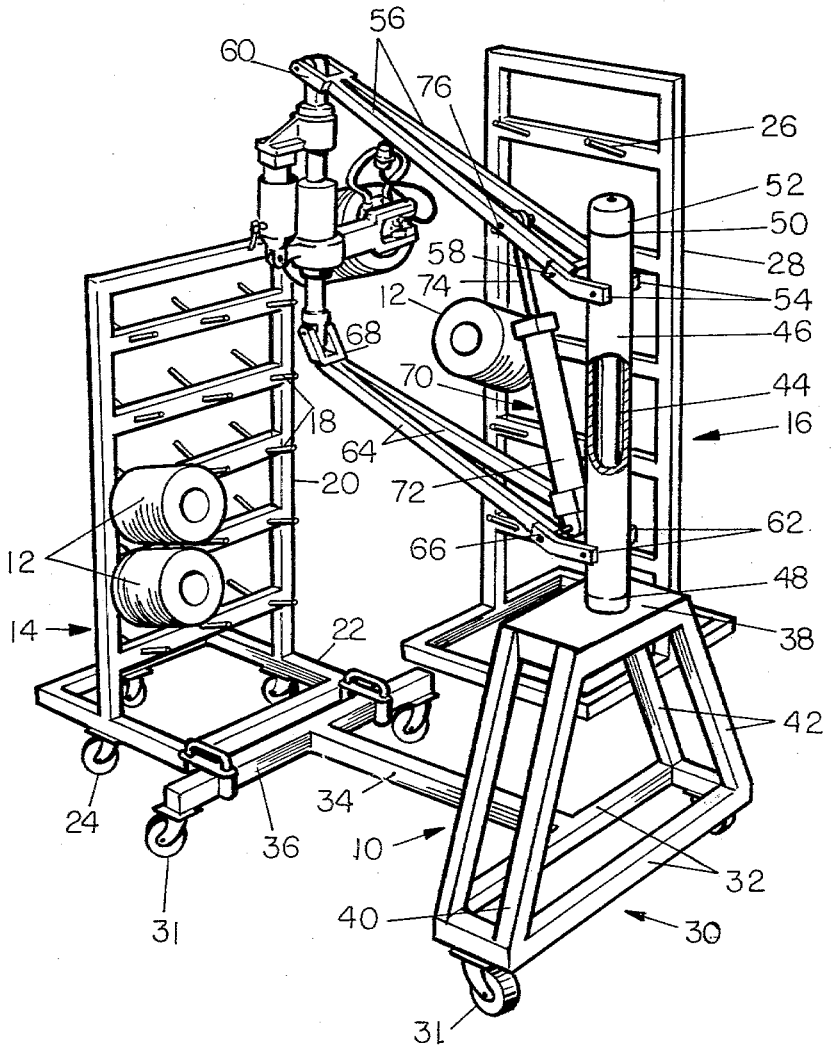
FIG. 1 is a somewhat schematic, overall view in perspective of a bobbin-handling cart and a bobbin buggy in accordance with the invention, and a creel rack.

Referring to the drawings, and particularly to FIG. 1, a bobbin-handling cart indicated at 10 is used to transfer bobbins 12 from a bobbin buggy or cart 14 to a creel rack 16. The bobbins 12 are transported from a spinning area by the buggy 14, being located on pins 18 of a frame 20 mounted on a base 22 having casters 24. The bobbins 12 also could be transported in a carton located on the base 22 of the buggy 14. Whether on the pins or in cartons, the bobbins are transferred to pins 26 extending from a creel rack 28 for further processing.

The bobbins commonly weigh 25 to 30 lbs and some weigh in the order of 100 lbs. Even the smaller bobbins can be tiring to workers handling them all day and if the bobbins are dropped, the damage to the threads can render the bobbins almost valueless. Further, moisture from the workers' hands can damage some filaments or yarn, particularly if they are of glass. The bobbin-handling cart 10 overcomes the above problems by assisting the operator through offsetting most of the weight of the bobbins and the bobbins need not be touched by the operator or worker.

The bobbin-handling cart 10 includes a base 30 with wheels 31 and having a pair of cross frame members 32 connected by a longitudinal frame 34 to another cross frame member 36 at the other end of the cart. A platform 38 is located above the pair of cross frame members 32 and is supported by two pairs of slanted frame members 40 and 42.

A pivot rod or axle 44 is rigidly mounted on the platform 38 and extends upwardly therefrom. An elongate member or sleeve 46 is located around the pivot rod 44 and is supported at the bottom by a thrust bearing 48, with another thrust bearing 50 being located at the top, under a cap 52 affixed to the upper end of the rod 44. A pair of ears 54 are suitably affixed to an upper portion of the elongate member 46 with a pair of linkages 56 pivotally connected to the ears 54 by pins 58. The outer ends of the links 56 terminate in a yoke 60. A pair of lower ears 62 are suitably affixed to a lower portion of the elongate member 46 and a pair of lower links 64 are affixed to the lower ear 62 by a pin 66 and positioned generally parallel to the links 56. The outer ends of the links 64 terminate in a yoke 68.

A fluid-operated ram 70 is mounted to urge the links 56 and 64 upwardly when pressure is supplied to the blind end. The ram 70 has a cylinder 72 which is pivotally connected to the ears 62 and the links 64 by the pin 66. The ram 70 also has a piston rod 74 pivotally connected at its upper end to the links 56 by a pin 76 at a position substantially spaced from the elongate member 46. Thus, when pressure is applied to the blind end of the cylinder 72, the piston rod 74 tends to extend and raise the links 56 and 64.

Figure 2:
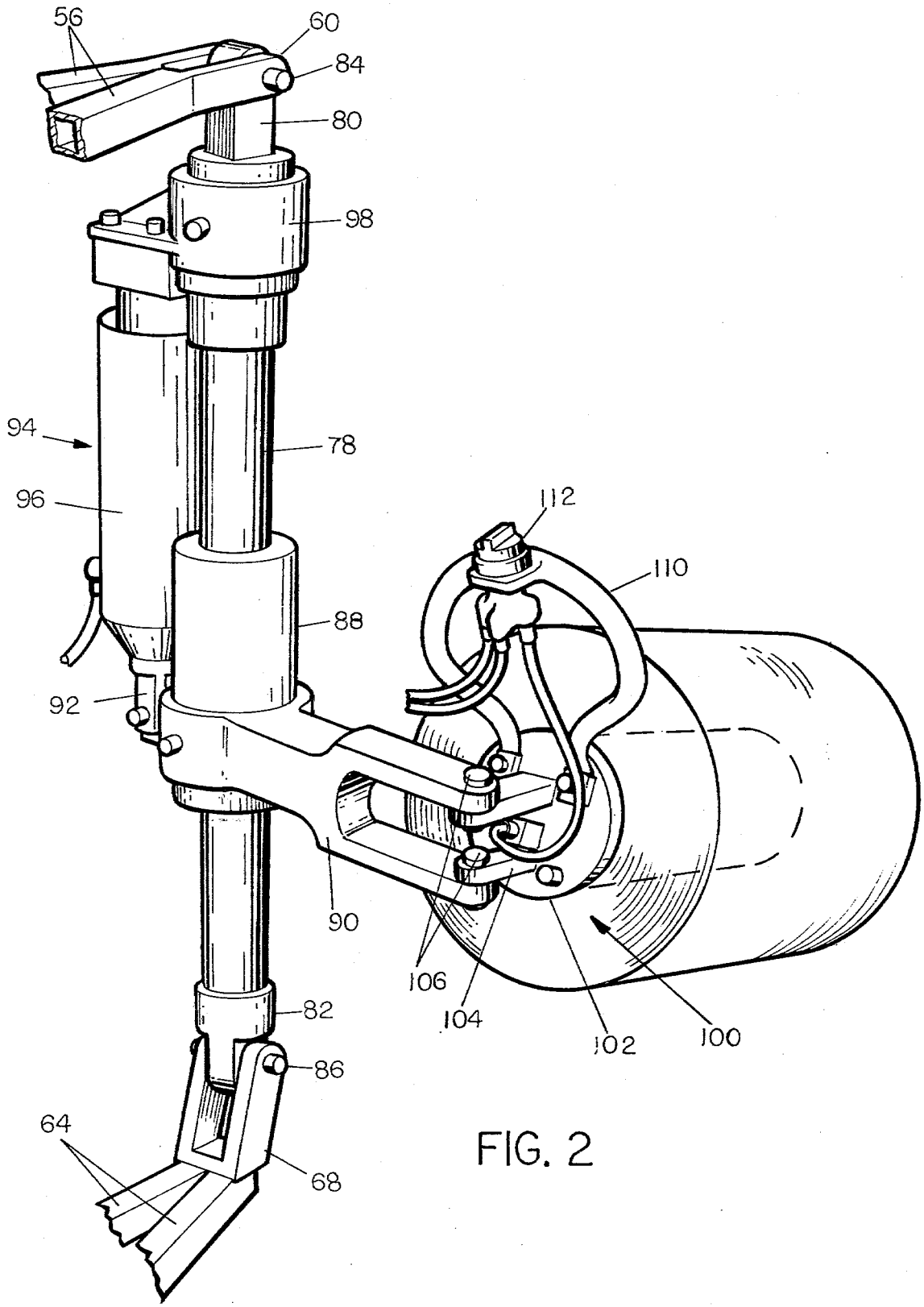
FIG. 2 is an enlarged, fragmentary view in perspective of a portion of the bobbin-handling cart of FIG. 1.

An outer elongate member or rod 78 has upper and lower ears 80 and 82 pivotally connected to the upper yoke 60 and the lower yoke 68 by pins 84 and 86. A bearing sleeve 88 and specifically a ball bushing is located on the elongate member 78 for pivotal movement about a vertical axis and, in this instance, also for vertical movement. A bracket 90 located on the bearing sleeve 88 is connected to a piston rod 92 of a second fluid-operated ram 94 having a cylinder 96 connected to a thrust bearing 98 suitably mounted for pivotal, but non-longitudinal, movement at an upper end portion of the elongate member 78. With this arrangement, the fluid-operated ram 94 can pivot around the elonage member 78 along with the bearing sleeve 88 and the bracket 90. When fluid under pressure is supplied to the rod end of the cylinder 96, the piston rod 92 tends to retract into the cylinder 96 to urge the bearing sleeve 88 and the bracket 90 upwardly relative to the elongate member 78. The sleeve and bracket are shown in their uppermost position in FIG. 2.

A bobbin-engaging unit 100 is preferably pivotally carried by the bracket 90. The unit 100 includes a circular mounting plate 102 from which ears 104 extend, the ears being pivotally connected to the bracket 90 by pins 106. An expandable member or inflatable bag 108 (FIG. 3) extends forwardly of the mounting plate 102 and can be supplied with air under pressure to expand its diameter and engage the inner surface of the bobbin 12. A manipulating handle 110 extends upwardly from the mounting plate 102 and carries a selector switch 112 which is effective to supply fluid under higher pressure to the inflatable bag 108, and to the fluid-operated rams 70 and 94, as will be discussed subsequently.

Figure 3:
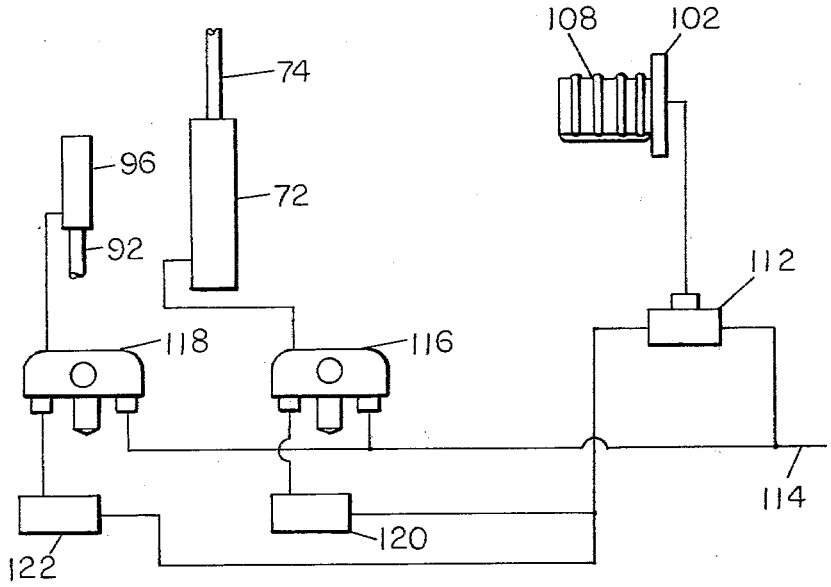
FIG. 3 is a diagrammatic view of fluid controls for the apparatus of FIGS. 1 and 2.

The controls for the cylinders 72 and 96 and the air bag 108 are shown in FIG. 3. Fluid, and specifically air, for the components is supplied through a line 114. This line can be a flexible one extending from the bobbin-handling cart 10 to a suitable source of shop air or, alternately, a tank of compressed air, which is recharged from time-to-time, can be carried on the cart. The controls preferably are mounted under the platform 38 in FIG. 1.

Air pressure in the cylinder 72 is controlled through a regulator 116 which can be generally of the type shown in U.S. Pat. No. 3,457,837 issued on July 29, 1969. A similar regulator 118 controls the air pressure in the cylinder 96. The air is maintained by the regulator 116 for the cylinder 72 at either of two pressures, a lower pressure and a higher pressure, as determined by a two-position control valve 120 which controls the pressure of pilot air to the regulator. Similarly, air is maintained at either of two pressures, a lower pressure and a higher pressure, by the regulator 118 for the cylinder 96, as determined by a two-position control valve 122 which controls the pressure of pilot air to the regulator. This control system is disclosed and discussed more fully in U.S. Pat. No. 3,756,563, issued on Sept. 4, 1973.

The lower pressure of air maintained in the cylinder 72 is selected so that an operator can move the bobbin-engaging unit 100 up and down by applying only a slight pressure in either direction. Thus, the pressure is sufficient to offset the weight of the various linkages 56 and 64 and the outer elongate member 78, along with the outer ram 94, the bearing sleeve 88, and the bracket 90. The higher pressure of air maintained in the cylinder 72 is selected so that it also offsets the weight of the various components plus the weight of the bobbin 12 engaged by the unit 100. Thus, when a bobbin is carried by the unit, the operator again can move the bobbin and components up and down by applying only a slight pressure by hand to the unit 100 or to the handle 110 thereof.

The design of the outer elongate member 78 and related components provides, through the extra vertical movement of the unit 100, additional manipulation to facilitate the alignment and entry of the air bag 108 into the bobbin 12. The lower pressure of the air supplied to the cylinder 96 is sufficient to offset the weight of the unit 100, the associated bracket 90, and the bearing sleeve 88. The higher pressure is sufficient to offset the weight of those components and the bobbin 12 engaged by the bag 108 of the unit 100. The design is such that the operator, in moving the handle 110 up or down, will usually cause the overall parallel linkages 56 and 64 to move up and down before the bushing 88 moves up or down on the elongate member 78. However, the reverse can occur and which moves first is essentially immaterial.

When the selector switch is moved to its high pressure position after the air bag 108 is inserted in the bobbin 12, air from the source 114 is supplied under high pressure to the bag 108 to expand it. At the same time, higher pressure air is supplied through the selector switch 112 to the two-position valves 120 and 122. These, in turn, supply higher pressure pilot air to the regulators 116 and 118 which causes them to maintain the higher pressure air in the cylinders 72 and 96. As the bobbin and mechanism are moved up by the operator, additional air is supplied into the cylinders by the regulators. When the bobbin and mechanism are moved down by the operator, the regulators exhaust air from the cylinders 72 and 96. Consequently, only a small force is required by the operator to move the bobbin up and down as well as to move it horizontally.

It is to be understood that other bobbin-engaging units can be employed. Also, the links 56 and 64 and related mechanism can be suspended from a pair of parallel, overhead rails by rollers or wheels, if desired. The buggy 14 would then be movable independently.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Bobbin-handling apparatus comprising a frame, an upright elongate member, means pivotally mounting said upright member on said frame for pivotal movement about a generally vertical axis, a bobbin-engaging unit, linkage means connecting said engaging unit and said upright member to enable generally vertical movement of said engaging unit with respect to said upright member, said linkage means including two generally parallel links pivotally connected to spaced portions of said upright member, an outer member pivotally connected to outer end portions of said links and spaced from said upright elongate member, said engaging unit being carried by said outer member, and a bracket carried by said outer member and pivotally connected to said bobbin-engaging unit to enable said engaging unit to pivot about a generally vertical axis.

2. Bobbin-handling apparatus comprising a frame, an upright elongate member, means pivotally mounting said upright member on said frame for pivotal movement about a generally vertical axis, a bobbin-engaging unit, linkage means connecting said engaging unit and said upright member to enable generally vertical movement of said engaging unit with respect to said upright member, first fluid-operated means connected to said linkage means and effective to urge said linkage means upwardly when said fluid-operated means is supplied with fluid under pressure; said linkage means comprising a pair of links, an outer elongate member connected to outer portions of said links spaced from said elongate member, and means connecting said bobbin-engaging unit to said outer elongate member for pivotal and generally vertical movement with respect thereto; and second fluid-operated means carried by said outer elongate member and connected to said connecting means for urging said bobbin-engaging unit in an upward direction when said second fluid-operated means is supplied with fluid under pressure.

3. Bobbin-handling apparatus comprising a frame, means for movably supporting said frame, an upright elongate member, means pivotally mounting said upright member on said frame for pivotal movement about a generally vertical axis, a bobbin-engaging unit including an expandable member which can expand when supplied with fluid under pressure to engage the inner surface of the bobbin, linkage means connecting said bobbin-engaging unit and said upright member for vertical movement of said engaging unit with respect to said upright member, an outer member pivotally carried by said linkage means and spaced from said upright elongate member, said engaging unit being carried by said outer member for pivotal movement about a generally vertical axis, and fluid-operated means connected to said linkage means and effective to urge said engaging unit upwardly when said fluid-operated means is supplied with fluid under pressure.

4. Apparatus according to claim 1 characterized by said bobbin-engaging unit including an expandable member which can expand when supplied with fluid under pressure.

5. Apparatus according to claim 4 characterized by fluid-operated means connected to said linkage means and effective to urge said bobbin-engaging unit upwardly when said fluid-operated means is supplied with fluid under pressure, means for supplying fluid under a low pressure to said fluid-operated means and for substantially simultaneously supplying fluid under higher pressure to said fluid-operated means and to said expandable member.

6. Apparatus according to claim 1 characterized by fluid-operated means connected to said linkage means and effective to urge said bobbin-engaging unit upwardly when said fluid-operated means is supplied with fluid under pressure.

7. Apparatus according to claim 2 characterized by control means for supplying fluid under a lower pressure to said first and second fluid-operated means and for supplying fluid under higher pressure to said first and second fluid-operated means.

8. Apparatus according to claim 7 characterized by said bobbin-engaging unit including an expandable member which can expand when supplied with fluid under pressure, and said control means supplying fluid under pressure to said expandable member when supplying fluid under the higher pressure to said first and second fluid-operated means.

9. Bobbin-handling apparatus comprising a frame, an upright elongate member, means pivotally mounting said upright member on said frame for pivotal movement about a generally vertical axis, a bobbin-engaging unit including an expandable member to engage an inner surface of a bobbin, two generally parallel links pivotally connected to said upright elongate member, means connecting the other end of said links to said bobbin-engaging unit to enable said bobbin-engaging unit to pivot about a generally vertical axis, fluid-operated means connected to at least one of said links and effective to urge said links upwardly, and fluid-control means for supplying fluid under a selected low pressure to said fluid-operated means, and for supplying fluid under a selected higher pressure to said fluid-operated means and substantially simultaneously supplying fluid under pressure to said expandable means to cause said expandable means to expand.

10. Bobbin-handling apparatus according to claim 9 characterized by said connecting means comprising an outer elongate member pivotally connected to the end of said links, and bracket means mounted on said outer elongate member for pivotal movement about a generally vertical axis and connected to said bobbin-engaging unit.

11. Bobbin-handling apparatus according to claim 10 characterized by means pivotally connecting said bracket means to said bobbin-engaging unit.

12. Bobbin-handling apparatus according to claim 11 characterized by second fluid-operated means connected to said bracket means for urging said bracket means in an upward direction relative to said outer elongate member.

13. Bobbin-handling apparatus according to claim 12 characterized by said fluid-control means also supplying fluid under a selected low pressure to said second fluid-operated means and for supplying fluid under a selected higher pressure to said second fluid-operated means.

14. Bobbin-handling apparatus according to claim 9 characterized further by a bobbin buggy, and said frame having wheel means and means connecting said frame and said bobbin buggy.

* * * * *